US005553434A

United States Patent [19]

Tamura

[11] Patent Number: 5,553,434

[45] Date of Patent: Sep. 10, 1996

[54] PLATE FOR CONNECTING ELONGATED PLATES

[75] Inventor: Tadao Tamura, Fujisawa, Japan

[73] Assignee: Kabushiki Kaisha Chugiken, Kanagawa, Japan

[21] Appl. No.: 298,191

[22] Filed: Aug. 31, 1994

[51] Int. Cl.[6] ..... E04D 1/34; E04B 1/38

[52] U.S. Cl. ..... 52/545; 52/509; 52/512; 52/551; 52/712; 52/582.1

[58] Field of Search ..... 52/712, 509, 512, 52/533, 545, 546, 547, 549, 551, 543, 582.1

[56] References Cited

U.S. PATENT DOCUMENTS

| | | | |
|---|---|---|---|
| 2,182,523 | 12/1939 | Markowski | 52/509 |
| 2,858,584 | 11/1958 | Gaines | 52/509 |
| 3,265,420 | 8/1966 | Goodrich et al. | 52/509 |
| 3,886,704 | 6/1975 | Mattes | 52/546 |
| 4,638,532 | 1/1987 | Yang et al. | 52/512 |

FOREIGN PATENT DOCUMENTS

| | | | |
|---|---|---|---|
| 688482 | 6/1964 | Canada | 52/545 |

*Primary Examiner*—Michael Safavi
*Attorney, Agent, or Firm*—McGlew and Tuttle, P.C.

[57] ABSTRACT

The present invention has an arrangement that two ends of a rectangular metal plate are turned up and the two ends are caused to approach at the central portion of the rectangular metal plate while maintaining a small gap so that a flat-pipe-type connection plate is formed, and the ends of elongated metal plates are slightly bent downwards to form insertion members which are inserted into the upper central gap of the connection plate from two directions.

The thus-arranged structure causes rain in the connection portion to enter through the gap between the ends of the elongated plates corresponding to the upper central gap of the connection plate. Rain allowed to enter flows downwards through the flat-pipe-like connection plate. Since the lower portion of the connection plate is positioned upper than the lower elongated plate, rain is discharged onto the lower following elongated plate.

2 Claims, 3 Drawing Sheets

PLATE FOR CONNECTING ELONGATED PLATES

FIELD OF THE INVENTION

The present invention relates to a connection plate for sequentially connecting ends of adjacent elongated or principal plates to one another on the same level in a manner adaptable to a so-called horizontal roofing structure constituted by sequentially fastening joining portions or fastening portions formed by upwards or downwards bending uppermost or lowermost ends of elongated plates, such as elongated metal roof plates or wall plates, sequentially disposed in parallel in the vertical direction.

BACKGROUND OF THE INVENTION

As a connection plate for connecting longitudinal ends of elongated plates to make the elongated plates continue in the lengthwise direction, there have been a method of a type respectively inserting, from two directions, ends of elongated plates into two side grooves of a connection plate in the form of an H-shape facing side to establish the connection and a sandwich method of a type using abutting plates disposed onto the both sides of the elongated plates at the connection positions to hold the elongated plates. However, the conventional methods involve entering of rain occuring at the contact surface between the end of the elongated plates and the connection plate due to capillary phenomenon. Therefore, complete weathering (interruption and prevention of rain) cannot be realized.

SUMMARY OF THE INVENTION

The present invention has a concept which is contrary to the conventional weathering method for preventing entering of rain and which has an arrangement that water, which has entered through the connection portion, is guided into a connection plate formed into a chute and then water is guided onto a lower elongated plate so as to be discharged.

Accordingly, the present invention has an arrangement that two ends of a rectangular metal plate are turned up and the two ends are caused to approach at the central portion of the rectangular metal plate while maintaining a small gap so that a flat-pipe-type connection plate is formed, and the ends of elongated metal plates are slightly bent downwards to form bent (insertion) members which are inserted into the upper central gap of the connection plate from two directions.

The thus-arranged structure causes rain in the connection portion to enter through the gap between the ends of the elongated plates corresponding to the upper central gap of the connection plate. Rain allowed to enter flows downwards through the flat-pipe-like connection plate. Since the lower portion of the connection plate is positioned higher than the lower elongated plate, rain is discharged onto the lower elongated plate.

DETAILED DESCRIPTION OF THE INVENTION

The present invention has an arrangement that two ends of one rectangular plate are turned up to be caused to approach at the central portion of the rectangular plate while maintaining a small gap so as to be in the form of a flat-pipe-like shape. Furthermore, an upper portion of the gap at the central approaching portion is made to be a wide portion by cutting bent members along the approaching line. In addition, a plurality of upward wedge-like protrusions portions are formed in the vertical direction on a lower plate corresponding to the wide gap portion so that a central connection portion is formed. Moreover, a base, which is wider than the central connection portion, is brought into contact with the reverse side of the central connection portion while being bonded so as to be integrated. The base has, on the two ends thereof, backward bent portions serving as drain boards. Furthermore, the upper portion of the base is raised diagonally so as to be formed into a joining portion for fastening the upper portion of the elongated plate, while the lower portion of the same is bent downwards so as to be formed into a lower joining portion for joining the lower portion of the elongated plate.

Each of the elongated plates, the connection of which is established by the connection plate according to the present invention, has a lengthwise end which is bent downwards, the bent member being inserted into the gap in the central connection portion so as to be secured in the bag-like portion. The lower portion of the elongated plate is bent so as to be joined together with the lower joining portion of the base from an upper position, the lower portion as well as serving as a connection portion with a just or immediately lower elongated plate. The upper portion is bent diagonally upwards so as to serve as a portion for establishing the connection with an upper elongated plate.

Figure 2:
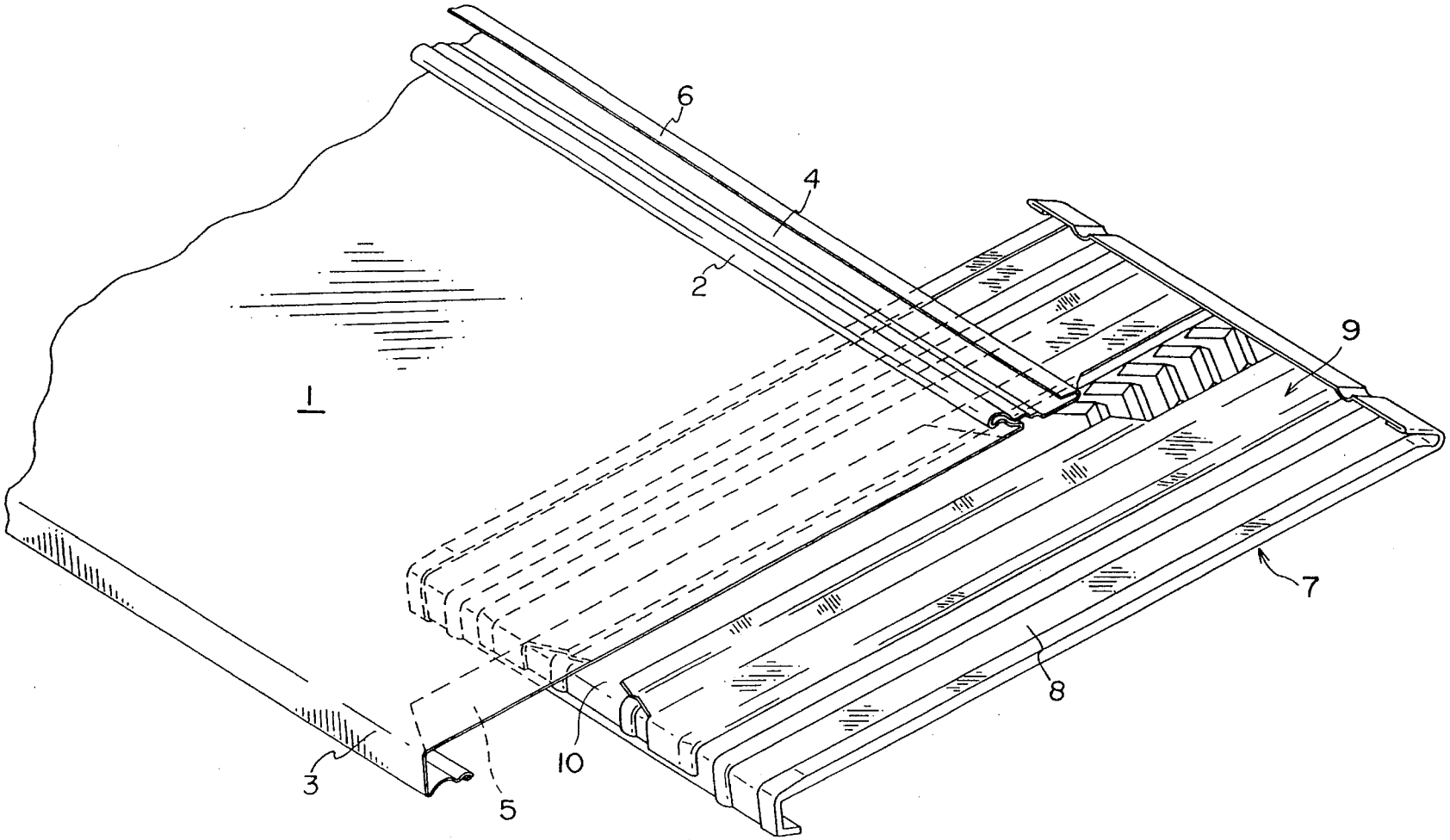
FIG. 2 is a perspective view which illustrates a state where roof plates are connected to each other.
Figure 3:
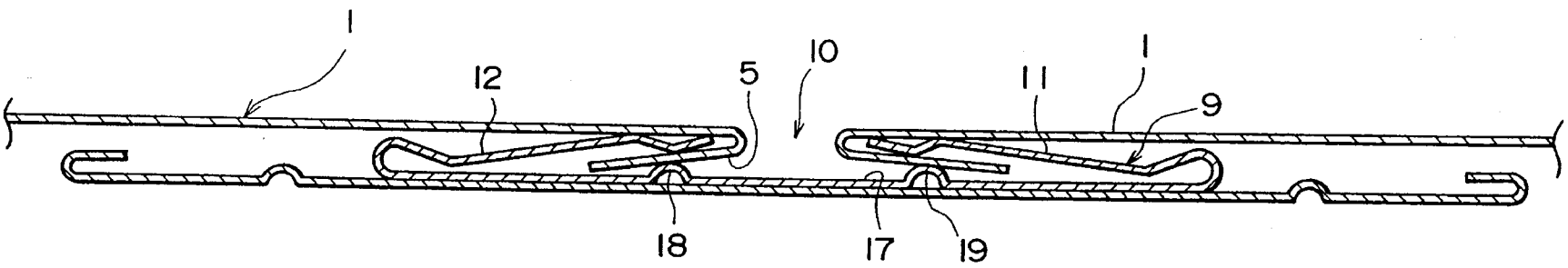
FIG. 3 is a horizontal cross section view.

As a result, when the bent member of the elongated plate is, as shown in FIG. 2, inserted into the gap of the connection plate and the connection is thus established, rain on the elongated plate is, as illustrated in the cross sectional view shown in FIG. 3, introduced through the gap in the connection plate, caused to flow downwards in the flat-pipe of the connection plate and discharged onto the just lower elongated plate.

By forming reinforcing vertical ribs on the lower plate of the central connection portion, a space is created in the central connection portion and transference of rain due to capillary phenomenon can be prevented. Even if rain exceeds the central connection portion, the presence of the base disposed below the central connection portion also prevents entering of rain.

In a case where the just or immediately upper portion of the elongated plate is not allowed to have the bent member due to a required molding process and therefore it is in the form of a single plate, the wide gap and the wedge-like protrusions formed in the just or immediately upper portion of the central connection portion cause rain on the elongated plate to fall from the end into the wide gap or cause rain to flow toward the wedge-like protrusions so as to be guided to an empty space in the connection plate before it falls downwards.

Thus, complete weathering can be realized. Furthermore, the connection of the elongated plates can easily be established because the connection operation is completed by simply inserting bent members of the elongated plates into the gap of the connection plate.

DETAILED DESCRIPTION OF PREFERRED EMBODIMENT

Figure 1:
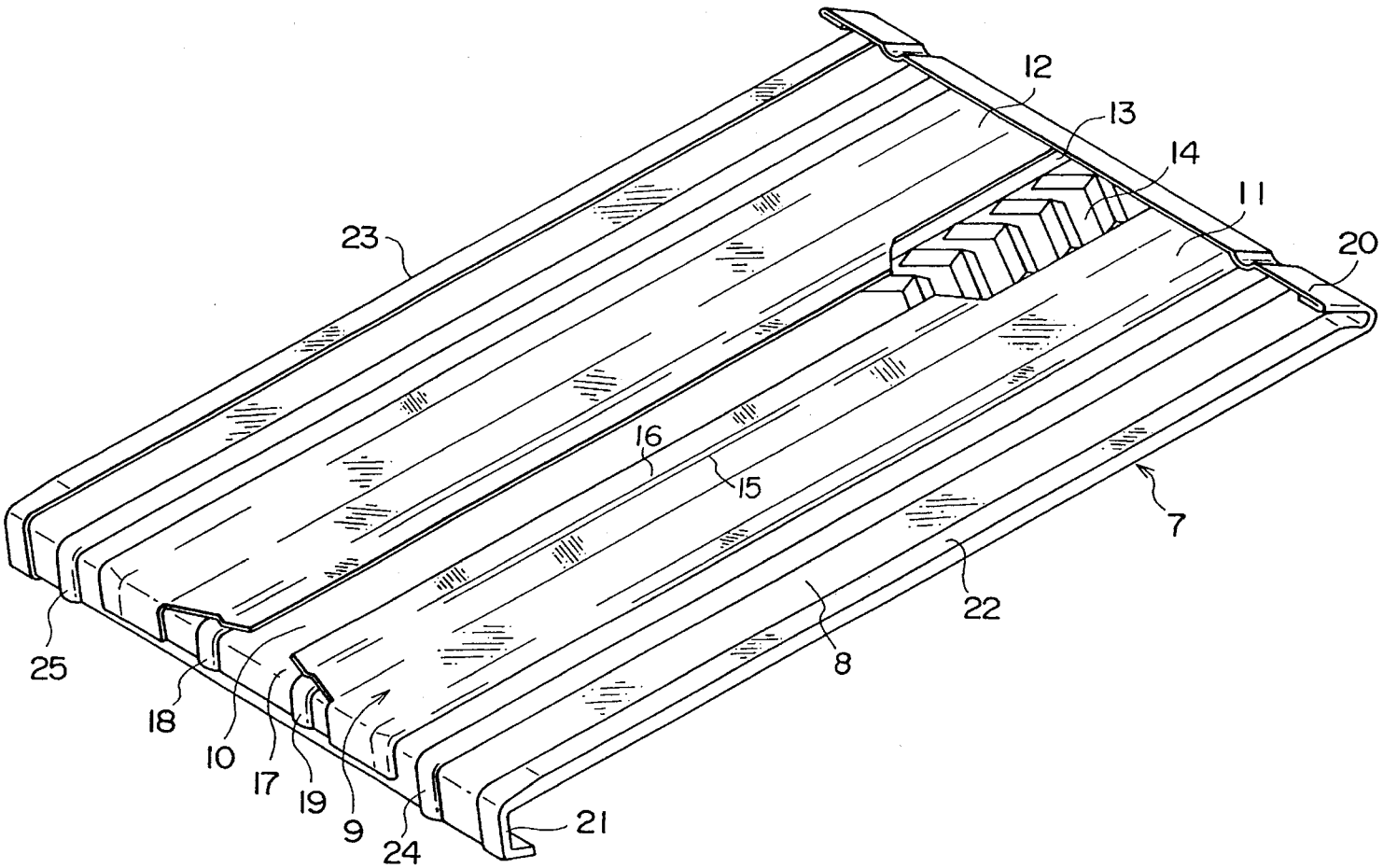
FIG. 1 is a perspective view of a preferred embodiment of the invention.

Elongated or principle plates, the connection of which is established by a connection plate according to the present invention, will now be described. The lengthwise-directional uppermost and lowermost ends of an elongated plate 1 respectively are, as shown in FIG. 2, bent upwards and downwards so that a joining portion or first joining means 2 and a joining portion or second joining means 3 for establishing other just or immediately upper and lower elongated or principle plates are formed. The upper joining portion 2 is further extended so as to have an extension portion 4 which is fastened with nails. The leading portion of the extension portion 4 is bent upwards so that a back board 6 is formed. An insertion member 5 is formed at a horizontal end of the elongated or principle plate 1 by bending downwards the same by a small length. A connection plate 7 shown in FIG.1 comprises a base 8 and a central connection portion 9 bonded to the upper surface of the central portion of the base 8. The central connection portion 9 is formed into a flat-pipe-like shape to form a pipe-like passage. The flat-pipe like shape is formed by turning up the two ends of a rectangular metal plate and by joining up the two ends while maintaining a small gap 10 at the central portion of the rectangular metal plate. The gap 10 is, in the upper portion thereof, formed into a wide gap 13 by slightly cutting the ends of two turned members 11 and 12 where the turned members 11 and 12 approach. A lower plate 17 of the central connection portion 9 corresponding to the wide gap 13 has a plurality of wedge-like protrusions 14 formed sequentially. Furthermore, each end of two turned members 11 and 12 has two bending lines 15 and 16 at the approaching portion so as to improve the strength. In addition, the lower plate 17 has reinforcing vertical ribs 18 and 19 on the two sides of the gap 10. As can be understood from a cross sectional view shown in FIG. 3, the vertical ribs 18 and 19 lift the approaching portions of the turned members 11 and 12, which are upper plates, form a receiving means and cause the insertion member 5 of the elongated plate 1 to be inserted easily. Furthermore, the vertical ribs 18 and 19 lift the insertion member 5 and the lower plate 17 to be in contact with each other hermetically so as to create a bag-like shape space to prevent entering of rain occurring due to a capillary phenomenon after the insertion member 5 has been inserted.

The central connection portion 9 is bonded on the central portion of the rectangular base 8 which is wider than the central connection portion 9. The base 8 has a joining portion 20 turned up so as to fasten the back board 6 of the elongated plate 1 at the upper end thereof. Also the lower end of the base 8 is, similarly to the joining portion 3 of the elongated plate 1, turned down into an L-shape so that a joining portion 21 is formed. The two horizontal ends of the base 8 are turned up so as to be formed into drain boards 22 and 23. In addition, reinforcing ribs 24 and 25 are formed on the two sides of the central connection portion 9. The lower end of the central connection portion 9 is, together with the turned members 11 and 12 of the upper plate and the lower plate 17, turned down along the lower joining portion 21 of the base 8. The ends of the turned members 11 and 12, at which they approach, have not the foregoing bent portion.

Since the connection plate 7 is constituted as described above, the insertion member 5 of the elongated plate 1 is, from a lower position, inserted into the gap 10 of the central connection portion 9 until the upper back board 6 comes in contact with the upper joining portion 20 of the connection plate 7. Another elongated plate 1 is inserted into a similar gap 10 so that the elongated plates 1 are connected to each other from the two directions. The cross sectional structure of the connection portion is shown in FIG. 3. Rain represented by arrows falls into the gap 10, and then it flows downwards between the two end ribs 18 and 19 of the lower plate 17 of the central connection portion 9. Thus, rain is discharged onto the lower elongated plate 1. Also entering of rain into the horizontal direction can be prevented by the hermetic contact brought by biasing or spring pressures of the turned members 11 and 12 of the central connection portion 9 i.e. bending stress thereof against the insertion member 5 through the ribs 18 and 19. If rain enters, the central connection portion formed into the flat-pipe-like shape prevents further entering of rain over the central connection portion 9.

Although the elongated plate 1 has not the inseration member 5 in the upper portion thereof, rain passing through the end of the elongated plate 1 falls into the wide gap 13 and then rain falls between the two ribs 18 and 19 of the lower plate 17 of the central connection portion 9. The presence of the wedge protrusions 14 formed in the lower portion of the wide gap 13 prevents the back flow of rain. Furthermore, rain is stopped by the joining portion 20 formed in the upper portion of the connection plate 7.

Since the connection plate according to the present invention enables the two-directional elongated plates to be connected by simply inserting the inseration members into the connection plate as described above, the connection operation can easily be performed. Furthermore, the rain prevention employs a method arranged on the contrary to the conventional concept such that rain is received and it is discharged onto the lower following elongated plate. Consequently, entering of rain can completely be prevented.

I claim:

1. A metal plate for sequentially connecting elongated metal plates, comprising:

a central connection portion formed by turning up two ends of a rectangular metal plate to cause said two ends to approach while maintaining a small gap so that a flat-pipe-like shape is formed and by slightly cutting ends of two turned members above said gap so that a wide gap is formed;

a base which is wider than said central connection portion and to which said central connection portion is bonded to the upper surface of the central portion of the base;

drain boards formed by slightly backwards bending two ends of said base;

a portion for joining an upper last elongated plate formed by upwards bending an upper portion of said base;

a portion for joining a lower following elongated plate roof formed by downwards bending a lower portion of said base into a L-shape; and an insertion member formed by downwards bending a lengthwise end of each of said elongated plates, said insertion members being inserted into said central gap of said central connection portion from two directions so that the connection is established.

2. A plate for sequentially connecting elongated plates according to claim 1, wherein a lower plate of the central connection portion corresponding to said wide gap in an upper plate thereof has a plurality of wedge-like protrusions formed sequentially in the vertical direction.

* * * * *